US010549298B2

(12) United States Patent
Wheatland et al.

(10) Patent No.: US 10,549,298 B2
(45) Date of Patent: Feb. 4, 2020

(54) PIVOT-TO-DISPENSE SOAP PUMP

(71) Applicant: Spectrum Brands, Inc., Middleton, WI (US)

(72) Inventors: Graham Wheatland, Vail, AZ (US); Adam Tracy, Irvine, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/977,483

(22) Filed: May 11, 2018

(65) Prior Publication Data

US 2018/0339306 A1 Nov. 29, 2018

Related U.S. Application Data

(60) Provisional application No. 62/511,084, filed on May 25, 2017.

(51) Int. Cl.
*B05B 11/00* (2006.01)
*A47K 5/12* (2006.01)

(52) U.S. Cl.
CPC ..... *B05B 11/3011* (2013.01); *A47K 5/1205* (2013.01); *A47K 2005/1218* (2013.01)

(58) Field of Classification Search
CPC ..... B05B 11/3011; A47K 5/1205; A47K 2005/1218
USPC ..... 222/321.1, 321.7–321.9
See application file for complete search history.

(56) References Cited

U.S. PATENT DOCUMENTS

| | | | | |
|---|---|---|---|---|
| 5,271,530 | A * | 12/1993 | Uehira | B05B 7/0037 222/190 |
| 5,287,996 | A * | 2/1994 | Uhlig | A47K 5/12 222/173 |
| 7,556,179 | B2 | 7/2009 | Yang et al. | |
| 7,815,077 | B2 | 10/2010 | Yang et al. | |
| 2007/0062975 | A1 | 3/2007 | Yang et al. | |
| 2014/0061243 | A1* | 3/2014 | Goettke | B05B 11/3001 222/182 |

* cited by examiner

*Primary Examiner* — Donnell A Long
(74) *Attorney, Agent, or Firm* — Merchant & Gould P.C.

(57) ABSTRACT

A pivot-to dispense soap pump includes an actuator that dispenses soap when actuated. The actuator is configured to move downward when actuated by user input. The downward movement may be in either one of a linear movement, maintaining the actuator is a horizontal orientation, or a pivoting movement about a pivot point. The pivot point is located on a distal end of the actuator, which is opposite the nozzle. The pivoting motion allows a user to depress the actuator proximate to the nozzle, thereby allowing the user to dispense soap into the same hand used to actuate the actuator. As a result, efficient, one-handed soap pumping and dispensing is enabled.

19 Claims, 6 Drawing Sheets

PIVOT-TO-DISPENSE SOAP PUMP

CROSS REFERENCE TO RELATED APPLICATIONS

This application claims priority to U.S. Provisional Application Ser. No. 62/511,084 filed on May 25, 2017, the entire contents of which are expressly incorporated by reference herein.

TECHNICAL FIELD

The invention is related to the field of fluid dispensers. More particularly, the invention is related to the field of soap dispensers that are mounted in a counter top.

BACKGROUND OF THE INVENTION

Soap dispensers are most commonly used in the kitchen and bathroom. For convenience, many soap dispensers are installed into the counter top next to the sink in the kitchen and bathroom. Although these mounted soap dispensers provide a level of convenience, there is room for improvement.

For example, it is instinctive for a user to reach for the soap dispenser with a single hand. Due to the mechanics of operating a manually pumped soap dispenser, it is difficult to press the actuator down with one hand and receive soap in the palm of that hand without using another hand. As a result, users have grown accustomed to pumping soap dispensers with one hand and receiving soap in the other hand. This action can be cumbersome and time consuming.

This disadvantage has been overcome by electronic soap dispensers with limited success. Electronic soap dispensers first sense when a user's hand is present and then automatically dispense soap. One drawback to electronic soap dispensers is that a pre-determined amount of soap is dispensed. Some users receive more than desired, while others receive less than desired. Additionally, false triggers may cause the electronic soap dispenser to dispense soap when there is no hand present to receive the soap. Furthermore, users may experience frustration when the electronic soap dispenser is low on or out of power or malfunctions.

Therefore, what is needed is a soap dispenser that is manually powered and suited for one-hand operation. What is also needed is a soap dispenser that may dispense soap with one-handed operation as well as two-handed operation, since some users are accustomed to this second type of experience. Lastly, what is further needed is an overall improved soap dispenser.

SUMMARY AND OBJECT OF THE INVENTION

The inventive soap pump preferably includes a pump mechanism configured to dispense soap when actuated. A piston within the pump mechanism generates suction when displaced in a downward direction. A movable anvil contacts the piston and urges the piston in a downward direction as the anvil is moved. A pivot point enables the anvil to selectively pivot about a pivot point such that pivoting the anvil urges the piston in the downward direction, thereby actuating the pump mechanism. The anvil is also movable in a downward direction, without pivoting, thereby also urging the piston in the downward direction and actuating the pump mechanism. The piston includes a piston head that has an angled slope. A similar angled slope on the anvil evenly contacts the angled slope of the piston head when the actuator is at rest.

An actuator extends from the pump mechanism and remains in a horizontal orientation when at rest. The actuator receives a selective user input causing movement of the actuator, thereby generating the movement of the anvil and piston. A nozzle on the distal end of the actuator, which is opposite the pump mechanism, is configured to dispense soap. A reservoir supplies soap to the pump mechanism through a pick-up tube, and the soap is dispensed by a rubber tube from the pump mechanism through the actuator and out of the nozzle.

The actuator includes a pivot pump zone and a linear pump zone that each receives the user input. When the user input is received in the pivot pump zone, the actuator causes a pivoting of the anvil, thereby urging the piston downward. The user input to the pivot pump zone of the actuator causes a pivot movement of the actuator, thereby causing the anvil to likewise pivot about the pivot point.

When the user input is in the linear pump zone, the actuator causes the anvil to move in the downward direction, without pivoting, and urges the piston downward. The linear pump zone is proximate to the pump mechanism, and the pivot pump zone is proximate to a nozzle of the actuator.

The soap pump also includes a base that houses the pump mechanism and a flange on the base configured to contact a counter top. A reservoir with a supply of soap supplies soap to the pump mechanism as the piston is urged in a downward direction.

BRIEF DESCRIPTION OF THE DRAWINGS

The present invention will be described hereinafter with reference to the attached drawings, which are given as non-limiting examples only, in which.

Figure 1:
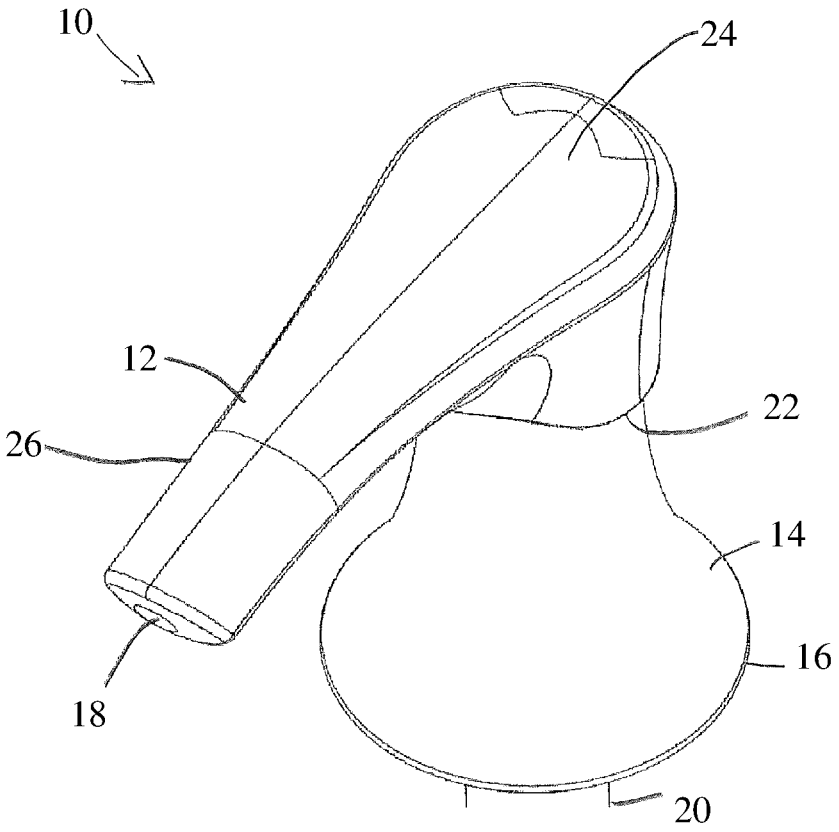
FIG. 1 is a raised, perspective view of a pivot-to-dispense soap pump according to the invention.

In the drawings, some structural or methodological features may be shown in specific arrangements and/or orderings. However, it should be understood that such specific arrangements and/or orderings may not be required. Rather, in some embodiments, such features may be arranged in a different manner and/or order than shown in the illustrative figures. Additionally, the inclusion of a structural or methodological feature in a particular figure is not meant to imply that such feature is required in all embodiments and, in some embodiments, may not be included or may be combined with other features.

Corresponding reference characters in the drawings indicate corresponding parts throughout the several views. The exemplification set out herein illustrates embodiments of the invention, and such exemplification is not to be construed as limiting the scope of the invention in any manner.

DETAILED DESCRIPTION

Figure 2:
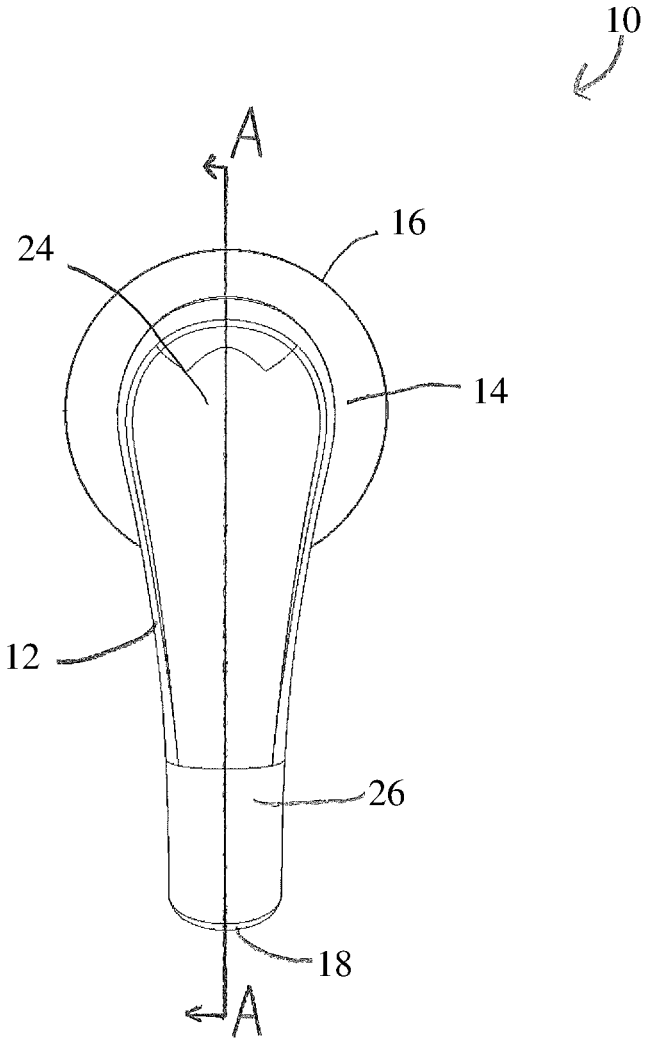
FIG. 2 is a top view of the soap pump of FIG. 1.

FIGS. 1 and 2 show a soap pump 10 according to an embodiment of the invention. The soap pump 10 includes an actuator 12 above a base 14. The base 14 also forms a closure for a soap reservoir 52 of the soap pump 10. This closure is supported by a counter top 51 and remains stationary with respect to the counter top 51. The base 14 supports the actuator 12 forming a seam 22 where they overlap. The seam 22 allows the actuator 12 to move vertically and pivot with respect to the base 14. A flange 16 forms the lower portion of the base 14 and provides support to mount the soap pump 10 onto a surface such as a counter top. A pick-up tube 20 feeds soap to the soap pump 10 from below the counter top as the actuator 12 is depressed.

The actuator 12 may be depressed in either the pivot pump zone 26 or the linear pump zone 24. Depression in either location will cause the actuator 12 to move, thereby activating a pump and drawing soap up through the pick-up tube 20, then through the piston bore 36, then through the rubber tube 19 and finally out of nozzle 18. Depressing the actuator 12 in the pivot pump zone 26 causes the actuator 12 to pivot downwardly. Depressing the actuator 12 in the linear pump zone 24 causes the actuator to uniformly compress into the base 14, while maintaining a horizontal orientation. In other words, the actuator 12 does not pivot when depressed in the linear pump zone 24. Similarly, the actuator 12 does not compress into the base 14 when depressed in the pivot pump zone 26. As a result, the soap pump 10 is capable of dispensing soap with one-handed operation.

One method of accomplishing one-handed operation is by pressing on the actuator 12 in the pivot pump zone 26 with a thumb. The palm of the hand is placed under the nozzle 18. By pivoting the actuator 12 downward with the thumb, soap is dispensed from the nozzle 18. With soap pumps, according to the prior art, the actuator is not capable of pivoting. Instead, the actuator 12 needs to be compressed into the base 14 for conventional operation. This requires a downward force in the linear pump zone 24. Depressing an actuator 12 of the prior art by the nozzle would produce a torque about the base 14, creating a lever arm, with the actuator 12 being the arm. This lever arm action does not compress the actuator 12 into the base 14 in an efficient manner, and, as a result, it is difficult for the user to pump soap with one hand. A typical user does not have a large enough hand to depress the linear pump zone 24 and receive soap from the nozzle 18 with the same hand. As a result, this type of operation is typically conducted with two hands; one hand would depress the linear pump zone 24, and the other hand would receive soap from the nozzle 18.

The inventive soap pump 10 is therefore operable to efficiently deliver soap with one-handed operation as well as traditional two-handed operation. Looking to FIG. 3, a section view of the soap pump 10 is shown along section line AA of FIG. 2. The internal operation of the soap pump 10 is shown with the soap pump in a state of rest, i.e., without any pressure applied to the actuator.

Figure 3:
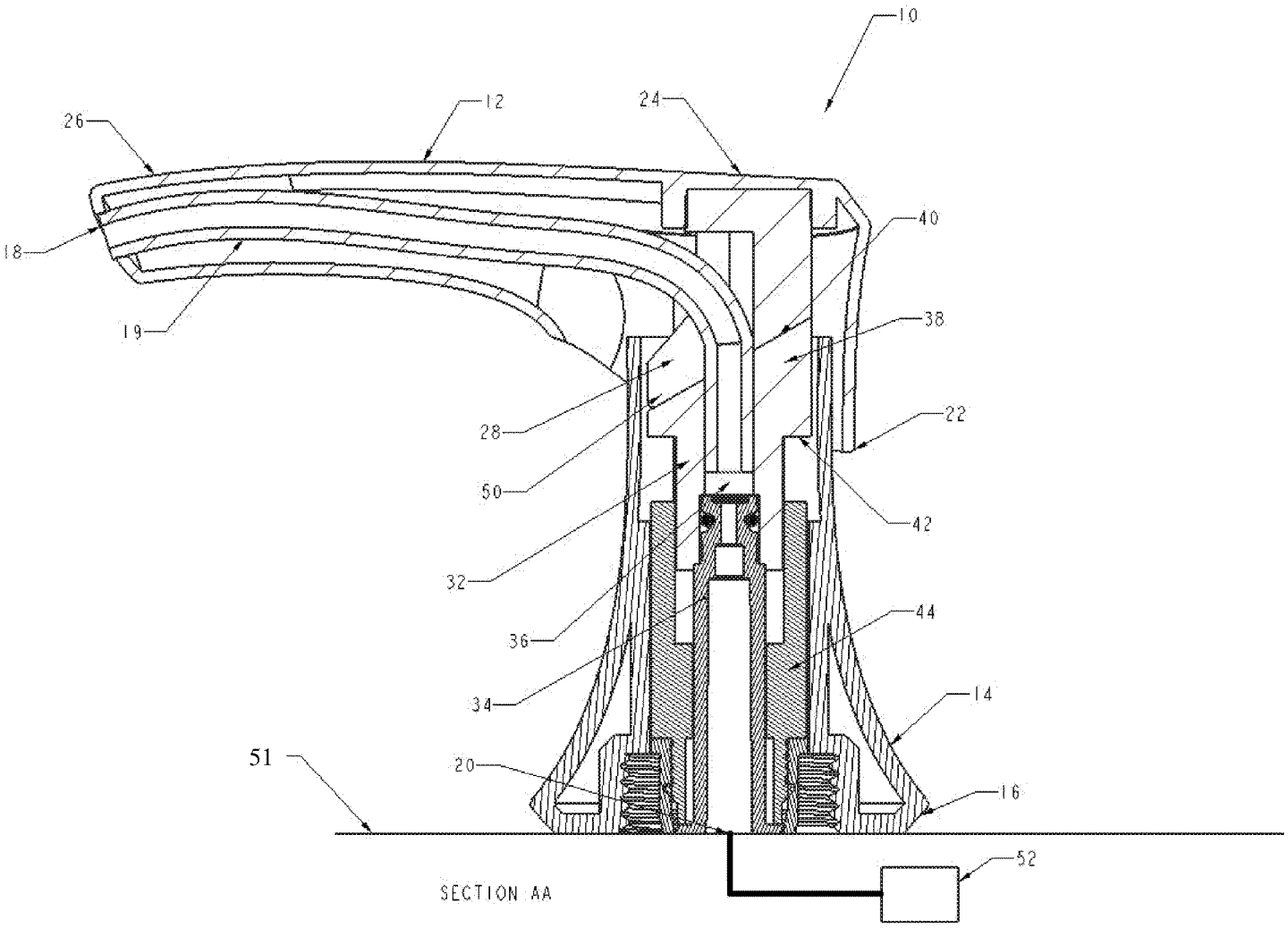
FIG. 3 is a section view of the soap pump along section line AA of FIG. 2, with the soap pump in a resting position.

FIG. 3 shows the reservoir 52 located below a counter top 51. A pick-up tube 20 fluidly joins the reservoir 52 to the pump mechanism 34. The pump mechanism 34 includes a stem 44 and a piston 32. The piston 32 is allowed to travel a stroke path into and out of the stem 44. The piston shoulder 42 contacts the stem 44 and limits the piston stroke. The piston 32 also includes a piston bore 36 that allows soap to flow from the pick-up tube 20, through the piston 32, into the actuator 12 via a rubber tube 19, and out of the nozzle 18. The piston 32 has a piston head 36 above the piston shoulder 42. The piston head 38 is sloped, thereby forming a piston slope 40. The piston slope 40 is sloped towards the nozzle 18, which helps the actuator 12 pivot when depressed on the pivot pump zone 26. The actuator 12 pivots about the pivot point 30. An anvil 28 is attached to the actuator 12 and includes an angled surface that is flush with the piston slope 40 when at rest. As the anvil 28 pivots with the actuator 12 about the pivot point 30, the anvil head 50 presses on the piston slope 40, thereby urging the piston 21 downward and into the stem 44. The motion of the piston 32 generates suction via activation of the soap pump mechanism 34, which draws soap from the reservoir 52. When the actuator 12 is released and pressure from the pivot pump zone 26 is removed, the actuator 12 returns to its normal, horizontal position, and the piston 32 extends out of the stem 44, as shown in FIG. 3.

Figure 4:
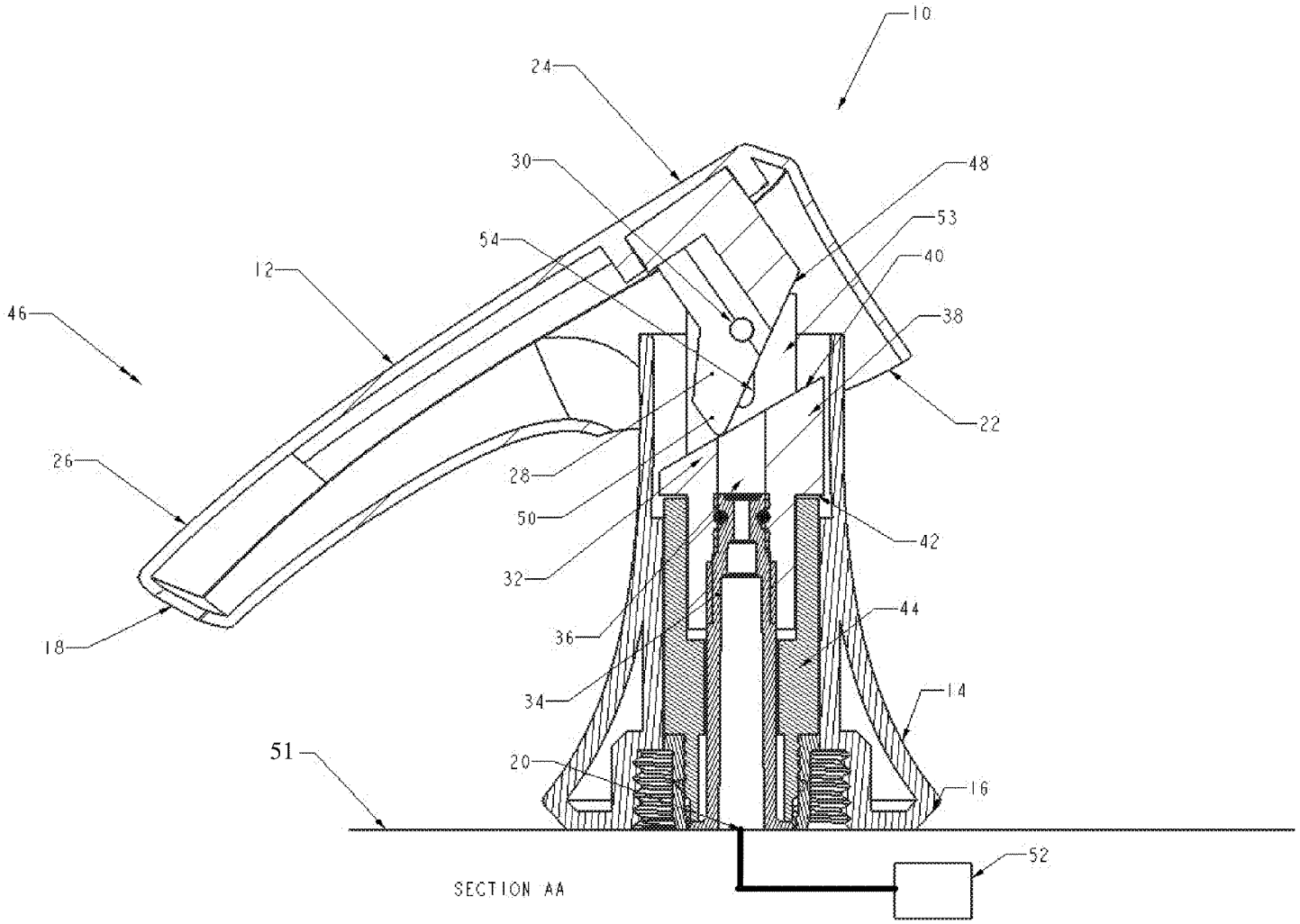
FIG. 4 is a section view of the soap pump along section line AA of FIG. 2, with the soap pump in a pivoted position, without the rubber tube.
Figure 5:
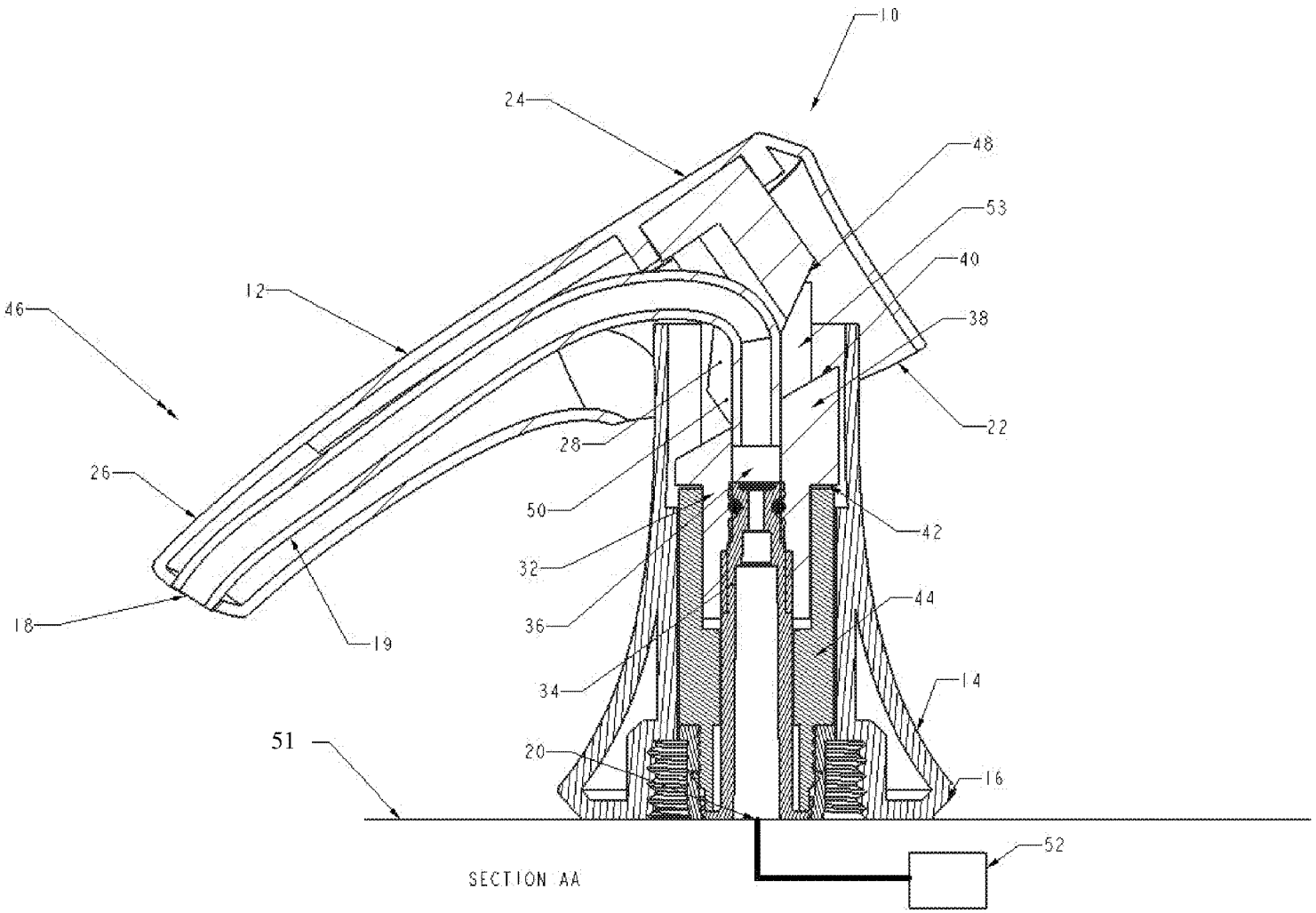
FIG. 5 is a section view of the soap pump along section line AA of FIG. 2, with the soap pump in a pivoted position, with the rubber tube.

FIGS. 4 and 5 show the pivoting action of the actuator 12 and the anvil 28 about the pivot point 30 when a downward force 46 is applied to the pivot pump zone 26. The rubber tube 19, as shown in FIG. 3, is removed in FIG. 4 to provide greater visual access but is shown in FIG. 5. The anvil head 50 glides along the piston slope 40 when the anvil is pivoted about the pivot point. The anvil head 50 compresses the piston 32 into the stem 44 to produce the pumping action in the pump mechanism 34. The angle of the piston slope 40 and the anvil slope 48 slope towards the nozzle, thereby making it easier to compress the piston 32 into the stem 44. The anvil 28 is affixed to the actuator 12, thereby allowing both to equally rotate about the pivot point 30. The pivot point 30 is supported by a support 53 above the piston 32. A slot 54 on the support 53 allows the anvil 28 and the actuator 12 to move without pivoting as shown in FIG. 5. After release of the downward force 46, the actuator 12 returns to the home position, as is shown in FIG. 3.

Figure 6:
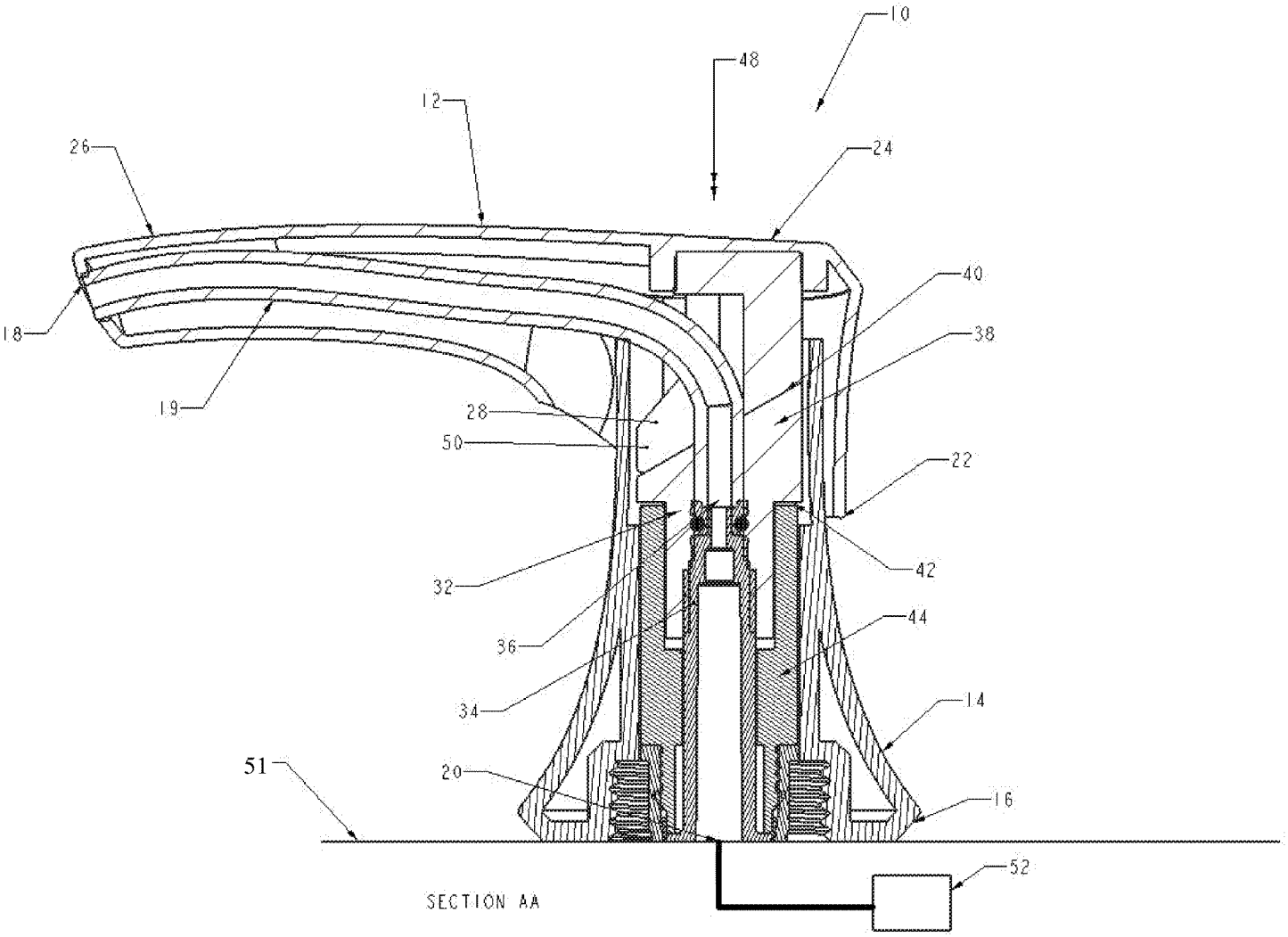
FIG. 6 is a section view of the soap pump along section line AA of FIG. 2 with the soap pump in a linearly compressed position.

FIG. 6 shows the soap pump 10 with the actuator 12 in a compressed state during application of a downward force 48 on the linear pump zone 24. As discussed above, the actuator 12 does not pivot when the downward force 48 is applied on the linear pump zone 24. Instead of pivoting about the pivot point 30, the anvil 28 slides down within the slot 54 on the support 53, which are visible in FIG. 4. As the anvil 28 moves downward, without pivoting, the anvil head 50 remains uniformly in contact with the piston head 38. The pump mechanism 34 operates the same, regardless of whether the pivot pump zone 26 is used or the linear pump zone 24 is used. As the actuator is compressed into the base 14, it is inserted deeper into the base 14. The seam 22 therefore moves downward as the actuator 12 is moved downward. The actuator 12 also remains in a horizontal orientation during the displacement. After release of the downward force 48, the actuator 12 returns to the home position, which is a state of rest, as is shown in FIG. 3.

While the soap pump 10 is shown mounted onto a counter top 51, it is foreseen that the soap pump 10 could be used in other applications as well. Use of the soap pump 10 in other applications does not depart from the spirit of the invention. Similarly, the actuator 12 may be formed in other shapes, while maintaining a distinct pivot pump zone 26 and a linear pump zone 24.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

We claim:

1. A soap pump comprising:
an actuator configured to dispense soap when actuated;
a base affixed to a counter top below the actuator;
a seam between the base and the actuator configured to allow the actuator to move with respect to the base;
a pump mechanism actuated upon movement of the actuator;
a piston configured for downward movement upon movement of the actuator and to draw soap into the actuator from a reservoir during the downward movement;
a piston head on the piston with an angled slope; and
an anvil with an angled slope within and affixed to the actuator, wherein the angled slope of the anvil contacts the angled slope of the piston head;
wherein the movement of the actuator is configured to be in a selectable direction including both a linear, downward direction and a pivot movement about a pivot point, and the movement of the actuator is transferred to the piston by the anvil.

2. The soap pump according to claim 1, wherein the actuator is removably coupled to the base, thereby allowing soap to be poured into the reservoir.

3. The soap pump according to claim 1, further comprising a flange on the base configured to contact a counter top.

4. The soap pump according to claim 1, further comprising:
a pivot pump zone on the actuator configured to accept a downward force to produce the pivot movement of the actuator;
a linear pump zone on the actuator configured to accept a downward force to produce the linear, downward direction of the actuator; and
wherein the linear pump zone is proximate the seam and the pivot pump zone is proximate a nozzle of the actuator.

5. The soap pump according to claim 1, wherein the pivot movement of the actuator causes the anvil to likewise pivot about the pivot point.

6. The soap pump according to claim 1, wherein the reservoir is fluidly coupled to the actuator from below the counter top.

7. A soap pump comprising:
a pump mechanism configured to dispense soap when actuated;
a piston within the pump mechanism configured to generate suction when displaced in a downward direction;
a movable anvil in contact with the piston configured to urge the piston in a downward direction when moved;
a pivot point enabling the anvil to selectively pivot about the pivot point such that pivoting the anvil urges the piston in the downward direction thereby actuating the pump mechanism; and
wherein the anvil is also movable in a downward direction, without pivoting, thereby also urging the piston in the downward direction, thereby actuating the pump mechanism.

8. The soap pump according to claim 7, further comprising:
an actuator configured to receive a selective user input causing movement of the actuator, thereby generating the movement of the anvil;
a nozzle on a distal end of the actuator, opposite the pump mechanism, configured to dispense soap;
a pivot pump zone and a linear pump zone both on the actuator; and
wherein the user input in the pivot pump zone of the actuator causes the pivoting of the anvil and the user input in the linear pump zone causes the anvil to move in the downward direction, without pivoting.

9. The soap pump according to claim 8, wherein the linear pump zone is proximate to the pump mechanism, and the pivot pump zone is proximate to a nozzle of the actuator.

10. The soap pump according to claim 8, further comprising:
a piston head on the piston with an angled slope;
an angled slope on the anvil within and affixed to the actuator, wherein the angled slope of the anvil contacts the angled slope of the piston head; and
wherein the movement of the actuator is transferred to the piston by the anvil.

11. The soap pump according to claim 8, wherein the user input to the actuator causes a pivot movement of the actuator, thereby causing the anvil to likewise pivot about the pivot point.

12. The soap pump according to claim 7, further comprising:
a base housing the pump mechanism;
a flange on the base configured to contact a counter top; and
a reservoir with a supply of soap configured to supply soap to the pump mechanism as the piston is urged in the downward direction.

13. The soap pump according to claim 12, wherein the reservoir supplies soap to the pump mechanism through a pick-up tube.

14. A method of dispensing soap comprising the steps:
applying a downward force to an actuator in a horizontal orientation, thereby displacing the actuator;
displacing a piston through the downward force, thereby actuating a pumping mechanism;
drawing soap through a pick-up tube into the actuator and out of a nozzle; and
wherein displacing the actuator is accomplished by applying the downward force in a selectable, predetermined location of the actuator, one of which produces a pivoting motion about a pivot point such that the actuator is angularly displaced with respect to the horizontal orientation and another of which produces a downward, linear motion of the actuator while maintaining the horizontal orientation.

15. The method of dispensing soap according to claim 14, further comprising:
providing a reservoir below a counter top to supply soap to the pumping mechanism;
mounting the actuator above the counter top; and
adding more soap to the reservoir by removing the actuator and pouring soap through the pumping mechanism from above the counter top.

16. The method of dispensing soap according to claim 15, wherein a base attaches the actuator to the counter top.

17. The method of dispensing soap according to claim 14, further comprising:
providing a piston head on the piston with an angled slope;
providing an angled slope on an anvil within and affixed to the actuator;
contacting the angled slope of the anvil with the angled slope of the piston head; and
displacing the actuator, thereby moving the anvil, which is transmitted to the piston.

18. The method of dispensing soap according to claim 14, wherein displacing the piston pumps soap from a reservoir, through the pick-up tube, through the piston, through the actuator, and out of the nozzle.

19. The method of dispensing soap according to claim 14, wherein the actuator freely swivels about the pumping mechanism.

* * * * *